US010706750B2

(12) United States Patent
Ertl

(10) Patent No.: US 10,706,750 B2
(45) Date of Patent: Jul. 7, 2020

(54) DISPLAY HEADER SYSTEM

(71) Applicant: WESTROCK CONTAINER, LLC, Atlanta, GA (US)

(72) Inventor: Joe Ertl, Richfield, MN (US)

(73) Assignee: WestRock Container, LLC, Atlanta, GA (US)

( * ) Notice: Subject to any disclaimer, the term of this patent is extended or adjusted under 35 U.S.C. 154(b) by 328 days.

(21) Appl. No.: 15/442,238

(22) Filed: Feb. 24, 2017

(65) Prior Publication Data

US 2017/0238727 A1 Aug. 24, 2017

Related U.S. Application Data

(60) Provisional application No. 62/299,232, filed on Feb. 24, 2016.

(51) Int. Cl.

| | |
|---|---|
| ***G09F 7/18*** | (2006.01) |
| ***G09F 5/02*** | (2006.01) |
| ***G09F 15/00*** | (2006.01) |
| ***B65D 5/00*** | (2006.01) |
| ***A47F 5/11*** | (2006.01) |
| ***B65D 5/52*** | (2006.01) |
| ***A47F 5/00*** | (2006.01) |
| ***G09F 23/06*** | (2006.01) |
| ***G09F 1/06*** | (2006.01) |

(52) U.S. Cl.

CPC ..... *G09F 7/18* (2013.01); *A47F 5/116* (2013.01); *B65D 5/00* (2013.01); *B65D 5/5226* (2013.01); *G09F 1/065* (2013.01); *G09F 5/02* (2013.01); *G09F 15/0062* (2013.01); *G09F 23/06* (2013.01); *A47F 2005/0075* (2013.01); *G09F 2007/1847* (2013.01)

(58) Field of Classification Search

CPC ..... G09F 7/18; G09F 5/02; G09F 5/00; G09F 1/065; G09F 1/10; G09F 1/103; G09F 2007/1847; G09F 15/0062; G09F 23/06; B65D 25/10; B65D 5/5233; B65D 5/5226; B65D 5/5246; B65D 5/52; B65D 5/00; A47F 5/116; A47F 2005/0075

USPC ..... 206/756, 758

See application file for complete search history.

(56) References Cited

U.S. PATENT DOCUMENTS

| | | | | |
|---|---|---|---|---|
| 3,884,349 | A * | 5/1975 | Charles | A47F 7/03 206/756 |
| 4,858,774 | A * | 8/1989 | Winter | A47B 96/04 211/184 |
| 5,351,882 | A | 10/1994 | Krautsack | |
| 5,979,338 | A | 11/1999 | Salmanson | |
| 6,126,131 | A | 10/2000 | Tietz | |
| 6,244,194 | B1 | 6/2001 | Salmanson e | |

(Continued)

FOREIGN PATENT DOCUMENTS

GB 2234959 A1 2/1991

OTHER PUBLICATIONS

U.S. Office Action dated Jul. 11, 2019 corresponding to U.S. Appl. No. 16/127,309, filed Sep. 11, 2018 (10 pages).

*Primary Examiner* — Rafael A Ortiz
(74) *Attorney, Agent, or Firm* — WestRock IP Legal

(57) ABSTRACT

A product display includes a display header and a cabinet. The display header is coupled to the cabinet for showing product indicia related to products stored in the cabinet to a customer at a retail location.

9 Claims, 11 Drawing Sheets

(56) References Cited

U.S. PATENT DOCUMENTS

| | | | | |
|---|---|---|---|---|
| 6,386,371 | B1 * | 5/2002 | Parsons | B65D 5/504 206/485 |
| 6,581,330 | B1 | 6/2003 | Helsloot | |
| 6,607,199 | B2 | 8/2003 | Gruber | |
| 6,609,466 | B2 | 8/2003 | Salmanson | |
| 6,722,292 | B2 | 4/2004 | Salmanson | |
| 6,857,642 | B2 | 2/2005 | Gruber | |
| 6,892,876 | B1 | 5/2005 | Aubry | |
| 6,925,943 | B2 | 8/2005 | Salmanson | |
| 7,004,379 | B2 | 2/2006 | Holdsworth | |
| 7,104,553 | B2 | 9/2006 | Gruber | |
| 7,159,521 | B2 | 1/2007 | Salmanson | |
| 7,407,086 | B2 | 8/2008 | Borio | |
| 7,681,783 | B2 | 3/2010 | Stephenson | |
| 7,766,348 | B2 | 8/2010 | McFarland | |
| 7,845,894 | B2 | 12/2010 | Dickinson | |
| 8,485,370 | B2 | 7/2013 | Dewhurst | |
| 8,561,816 | B2 | 10/2013 | Martin | |
| 8,584,860 | B2 | 11/2013 | Orischak | |
| 8,720,089 | B1 | 5/2014 | Lewis | |
| 8,733,563 | B2 | 5/2014 | Fadrowski | |
| 8,833,573 | B2 | 9/2014 | Tomaszewski | |
| 8,857,633 | B2 | 10/2014 | Dewhurst | |
| 8,863,417 | B2 | 10/2014 | Gerstner | |
| 8,978,280 | B2 | 3/2015 | Holt | |
| 8,991,624 | B2 | 3/2015 | Brozak | |
| 9,186,453 | B1 * | 11/2015 | Russell | A61M 5/1414 |
| 9,415,893 | B2 | 8/2016 | Wintermute | |
| 2004/0144837 | A1 | 7/2004 | Dye | |
| 2006/0124710 | A1 | 6/2006 | Sun | |
| 2009/0056891 | A1 * | 3/2009 | Wiwi | D21H 27/02 162/100 |
| 2014/0097122 | A1 | 4/2014 | Patterson | |
| 2016/0176570 | A1 | 6/2016 | Collier | |
| 2017/0267399 | A1 | 9/2017 | Buscema | |
| 2017/0297772 | A1 | 10/2017 | Davis | |

* cited by examiner

DISPLAY HEADER SYSTEM

PRIORITY CLAIM

This application claims priority under 35 U.S.C. § 119(e) to U.S. Provisional Application Ser. No. 62/299,232, filed Feb. 24, 2016, which is expressly incorporated by reference herein.

BACKGROUND

The present disclosure relates to a product display, and particularly to a product display having a display header and a cabinet. More particularly, the present disclosure relates to a product display having a display header attached to a cabinet for showing product indicia related to products stored in the cabinet to a customer at a retail location.

SUMMARY

A product display in accordance with the present disclosure includes a display header system and a cabinet. The display header system is coupled to the cabinet for showing product indicia related to products stored in the cabinet to a customer at a retail location.

In illustrative embodiments, the display header system includes a header board and a header mount. The header mount is coupled to the cabinet to support the header board on the cabinet. The header board includes a front side and a back side opposite the front side. The product indicia is positioned on the front side of the header board. The header board is movable from a shipping position to a display position relative to the cabinet. The product indicia is obscured by the cabinet when the header board is in the shipping position and visible when the header board is in the display position.

In illustrative embodiments, the header mount includes a bracket coupled to the cabinet and a board mover. The board mover is configured to move the header board from the shipping position to the display position at the selection of a user. The bracket is configured to control movement of the header board relative to the cabinet.

In illustrative embodiments, the bracket is secured to the cabinet by an adhesive strip. The board mover is coupled to the bracket and a lower end of the header board to support the header board relative to the cabinet for movement between the shipping and display positions.

In illustrative embodiments, the bracket includes a lock tab and a retainer tab coupled to the lock tab. The cabinet is formed to include a tab-receiving slot. The lock tab is configured to be received in the tab-receiving slot and the retainer tab is configured to engage with the cabinet to hold the bracket on the cabinet. The board mover is coupled to the cabinet and a lower end of the header board to support the header board relative to the cabinet for movement between the shipping and display positions.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
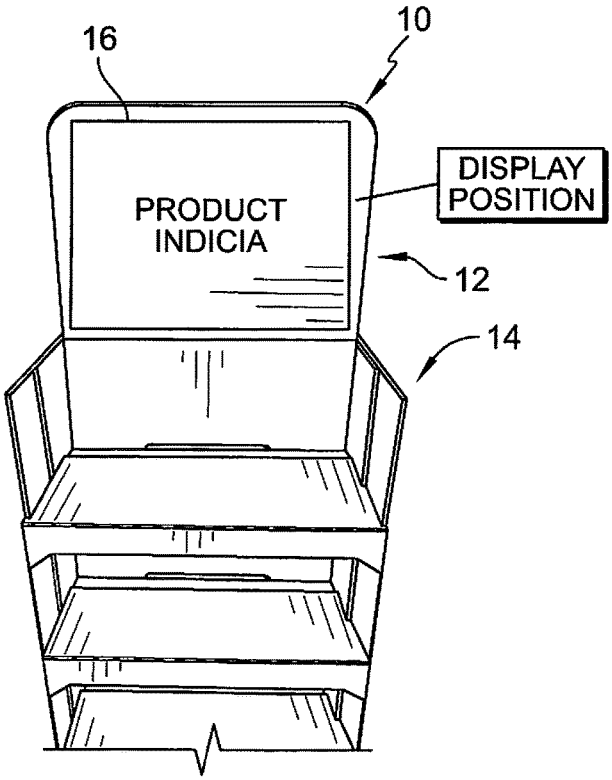
FIG. 1 is a front perspective view of a product display in accordance with the present disclosure showing that the product display includes a display header coupled to a cabinet for showing product indicia related to products stored in the cabinet to a customer at a retail location when the display header is in a display position.

A product display 10 in accordance with the present disclosure is shown in FIG. 1. Product display 10 includes a display header system 12 (also called a display header 12) coupled to a product support structure, such as a cabinet 14. Cabinet 14 is configured to support product for display in a retail setting. Product indicia 16 related to products stored in cabinet 14 is positioned on a front side of display header 12 and visible when display header 12 is in a display position as shown in FIG. 1.

Figure 2:
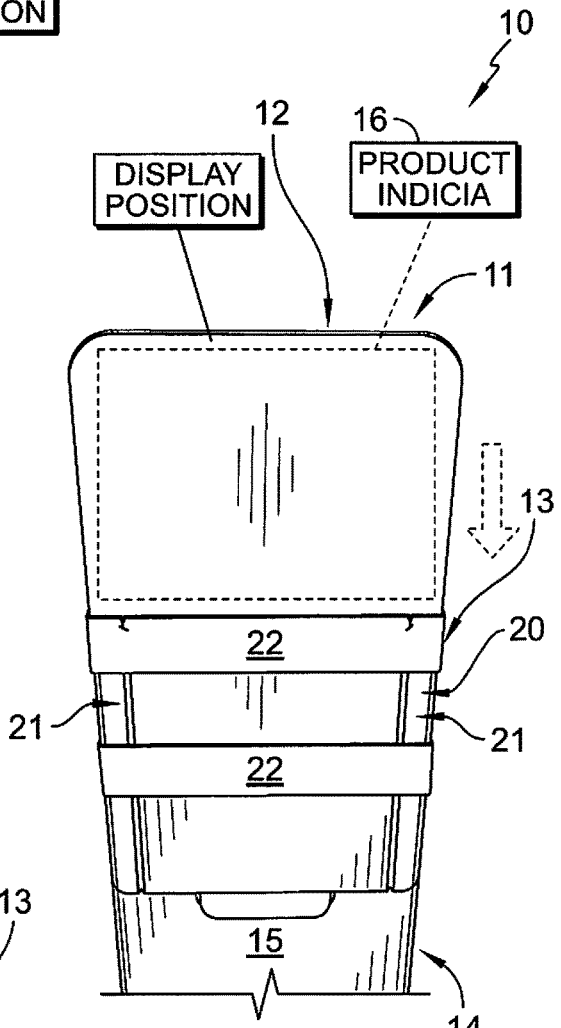
FIG. 2 is a rear perspective view of the product display of FIG. 1 showing that the display header includes a header board and a header mount configured to hold the header board on the cabinet for movement between the display position and a shipping position as suggested in FIG. 3.
Figure 3:
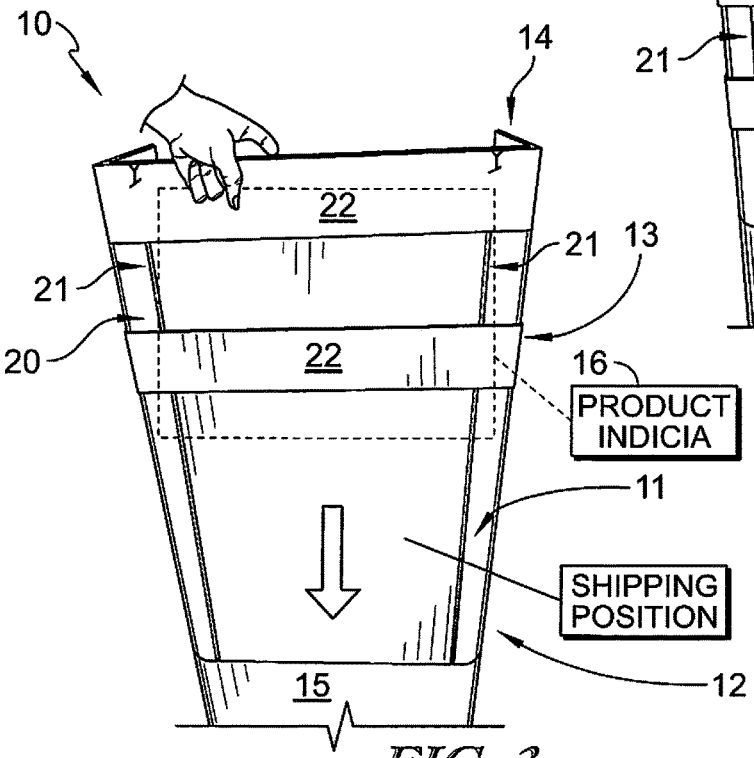
FIG. 3 is a view similar to FIG. 2 showing the header board in the shipping position and suggesting that the header board slides relative to the cabinet to obscure at least a portion of the product indicia when the header board is moved to the shipping position.

Display header 12 includes a header board 11 and a header mount 13 coupled to cabinet 14 to support header board 11 for movement relative to cabinet 14 between the display position, as shown in FIGS. 1 and 2, and a shipping position, as shown in FIG. 3, at the selection of a user. At least a portion of product indicia 16 is obscured from view when header board 11 is in the shipping position and a height of product display 10 is reduced compared to when header board 11 is in the display position. In the illustrative embodiment, header mount 13 biases header board 11 toward the display position to support the header board 11 in the display position for showing product indicia 16 to customers at a retail location as suggested in FIG. 2.

Header mount 13 includes one or more brackets 22 and a board mover 20 as shown in FIGS. 2 and 3. Brackets 22 are coupled to a back wall 15 of cabinet 14 and are configured to guide header board 11 during movement between the display and shipping positions. Board mover 20 is coupled between brackets 22 and header board 11 to support header board 11 in the display position. In some embodiments, board mover 20 is coupled between cabinet 14 and header board 11 to support header board 11 in the display position. Board mover 20 includes elastic members 21.

In the illustrative embodiment, two brackets 22 and two sets of elastic members 21 are used to form header mount 13 as suggested in FIGS. 2 and 3. Elastic members 21 are coupled between an upper bracket 22 and a lower end of header board 11. Elastic members 21 are configured to stretch when header board 11 is moved to the shipping position and bias header board 11 toward the display position. In the illustrative embodiment, elastic members 21 are formed as elongated strands of stretchable material The number of brackets 22 and elastic members 21 can be increased or decreased to adjust for size, weight, display position height, etc. of display header 12 and cabinet 14.

Figure 4:
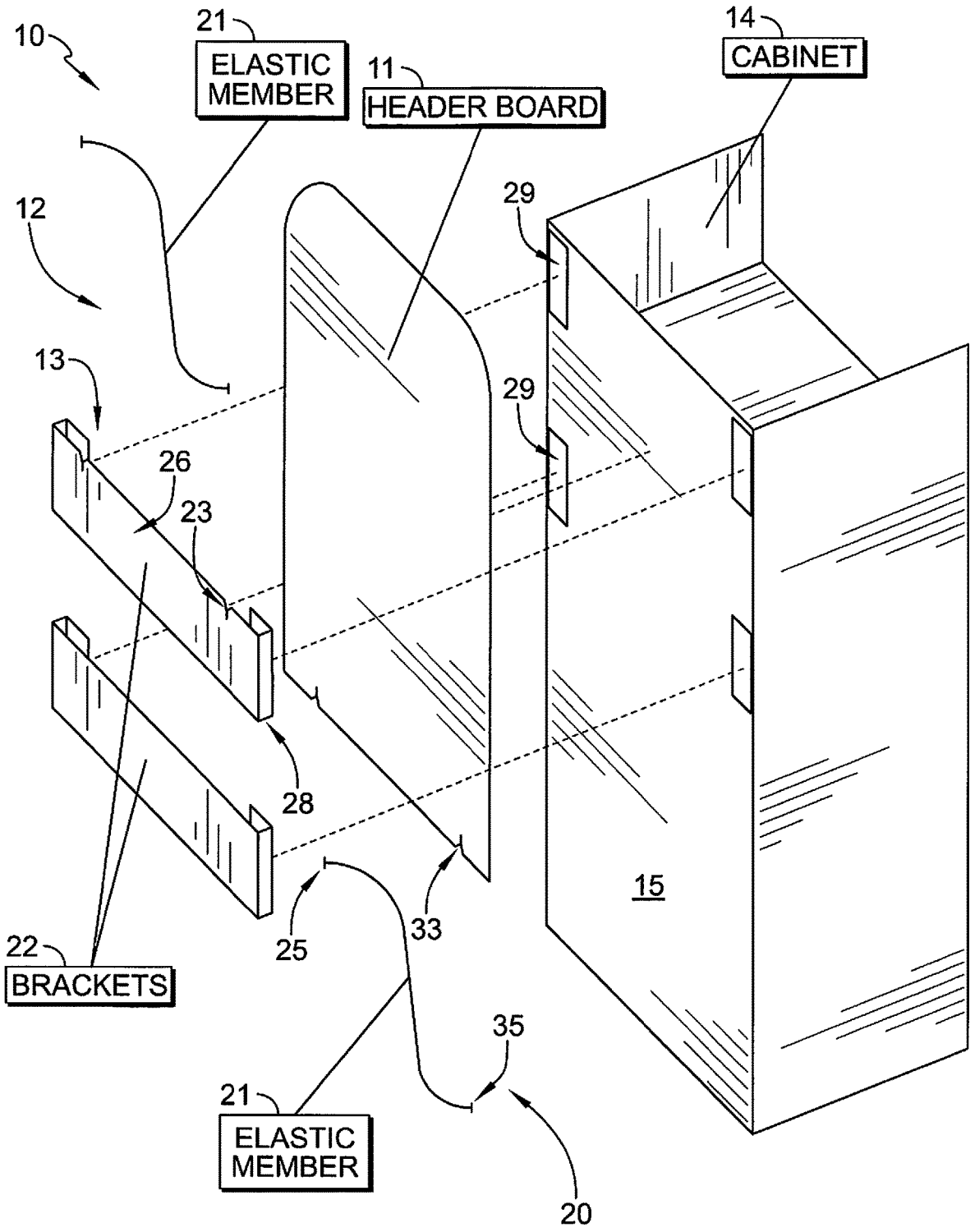
FIG. 4 is an exploded assembly view of the product display of FIG. 1 showing that the header mount includes brackets and elastic members and suggesting that the brackets engage with the cabinet to trap the header board between the brackets and the cabinet and that the elastic members engage with an upper bracket and the header board to bias the header board toward the display position.
Figure 5:
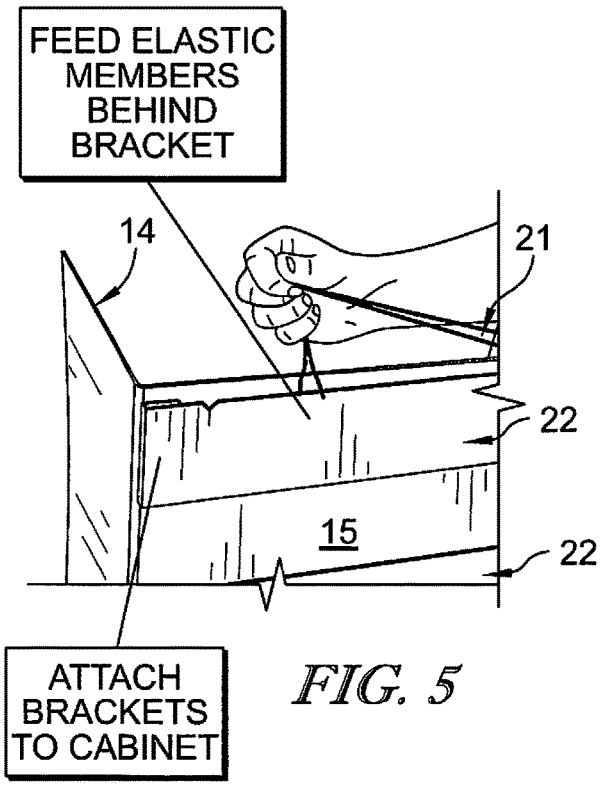
FIGS. 5-8 are a series of views showing a process in accordance with the present disclosure for attaching the elastic members to the bracket to form the header mount.
Figure 6:
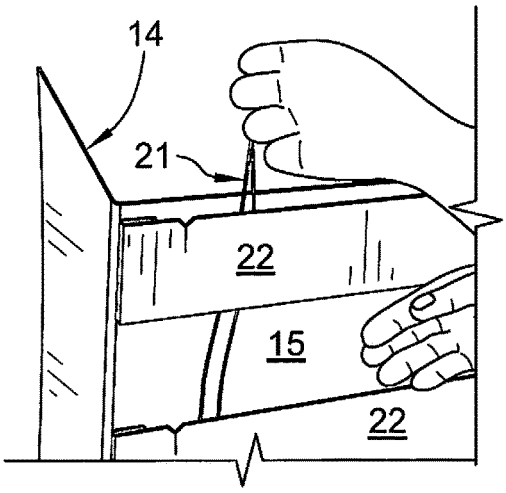
Figure 7:
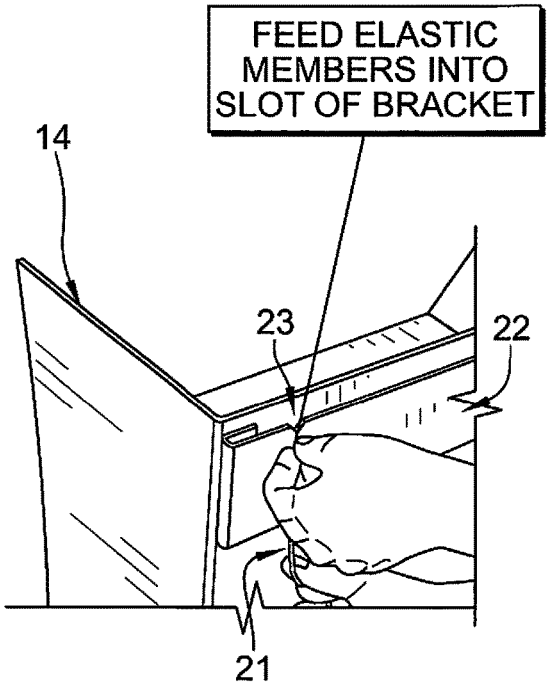
Figure 8:
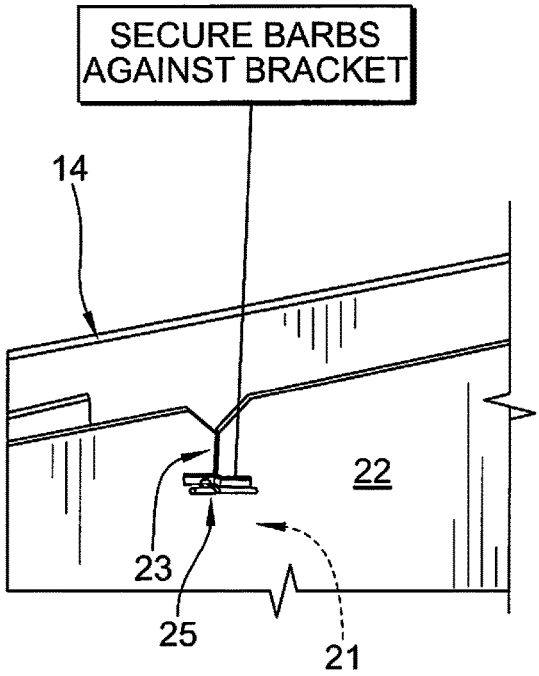

Brackets 22 and header board 11 are formed separate from cabinet 14 as suggested in FIG. 4. Brackets 22 include an elongated guide wall 26 and folding ends 28 extending form opposite sides of guide wall 26. In the illustrative embodiment, double-sided adhesive strips 29, or other adhesive material, are used to secure brackets 22 to cabinet 14. Brackets 22 attach to cabinet 14 to trap header board 11 between brackets 22 and cabinet 14 as suggested in FIG. 4.

One illustrative process for attaching display header 12 to cabinet 14 is shown in FIGS. 5-12. Ends 28 of brackets 22 are folded over guide walls 26 and engaged with adhesive strips 29 to attach brackets 22 to cabinet 14. Folding ends 28 are configured to space guide wall 26 from back wall 15 to define a slot for receiving header board 11.

Elastic members 21 are passed between bracket 22 and back wall 15 to position elastic members 21 for insertion into a slot 23 of upper bracket 22 as suggested in FIGS. 5-8. Barbs 25 coupled to ends of elastic members 21 are secured against bracket 22 when elastic members 21 are inserted into slot 23 to support elastic members on bracket 22 as suggested in FIG. 8. Elastic members 21 are also secured at an opposing end of bracket 22 in a similar way.

Figure 9:
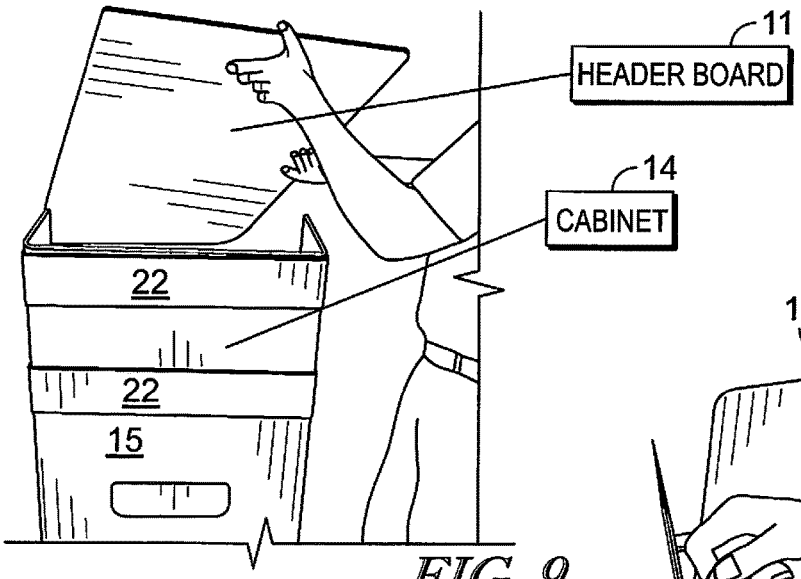
FIGS. 9-12 are a series of views showing a process in accordance with the present disclosure for attaching the header board to the header mount.
Figure 10:
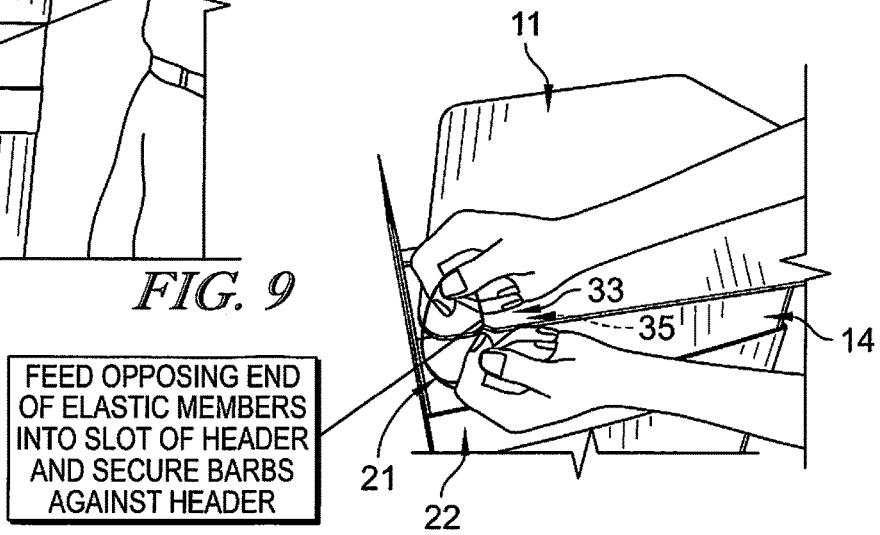

Header board 11 is positioned adjacent to cabinet 14 for attachment of elastic members 21 as suggested in FIGS. 9-10. Opposing ends of elastic members 21 from those attached to bracket 22 are inserted into a slot 33 of header board 11 as suggested in FIG. 10. Barbs 35 coupled to the ends of elastic members 21 are secured against header board 11 to block withdrawal of elastic members 21 from slot 33 during movement of header board 11 and to support header board 11 on upper bracket 22. Elastic members 21 are also secured at an opposing side of header board 11 in a similar way.

Figure 11:
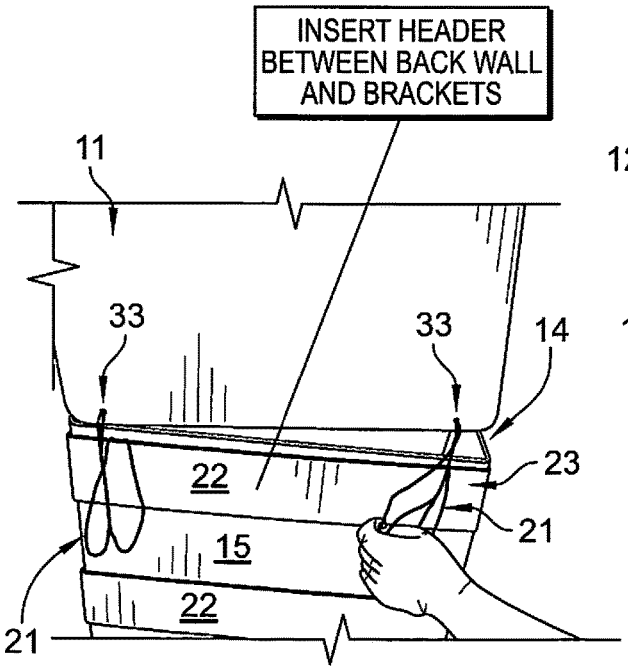
Figure 12:
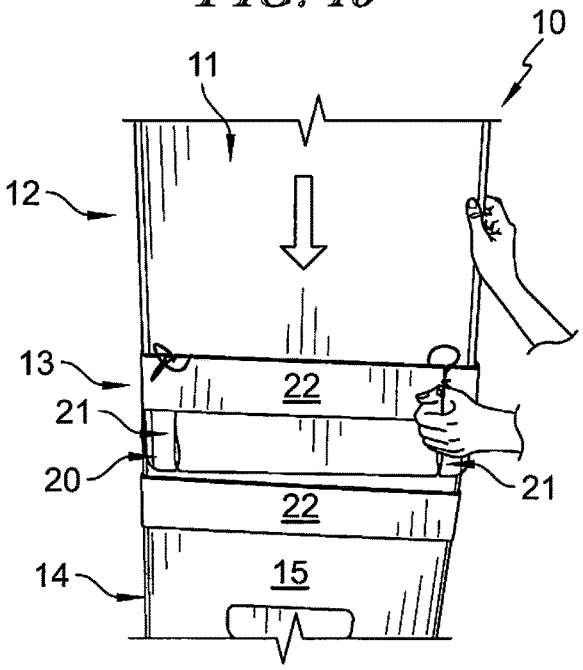
Figure 13:
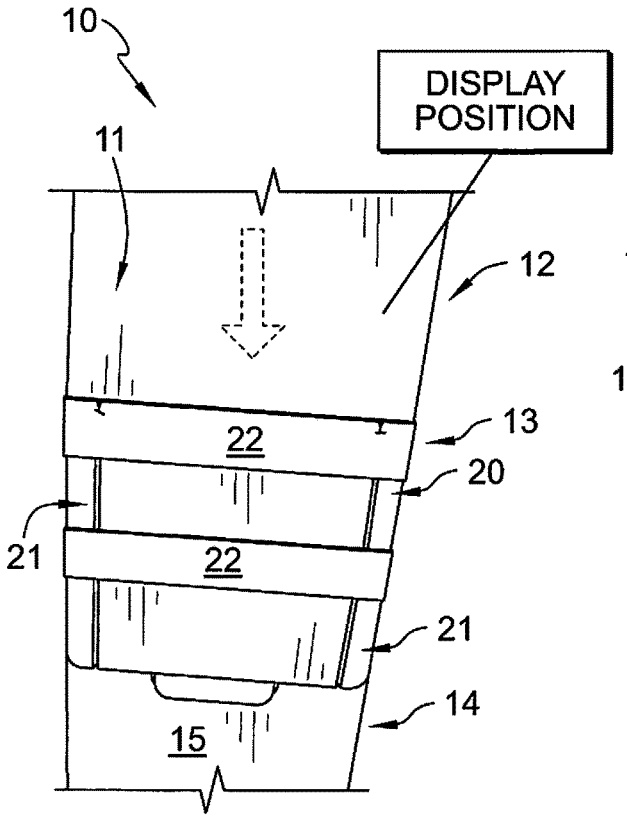
FIGS. 13-15 are a series of views showing the header board in various positions relative to the header mount.
Figure 14:
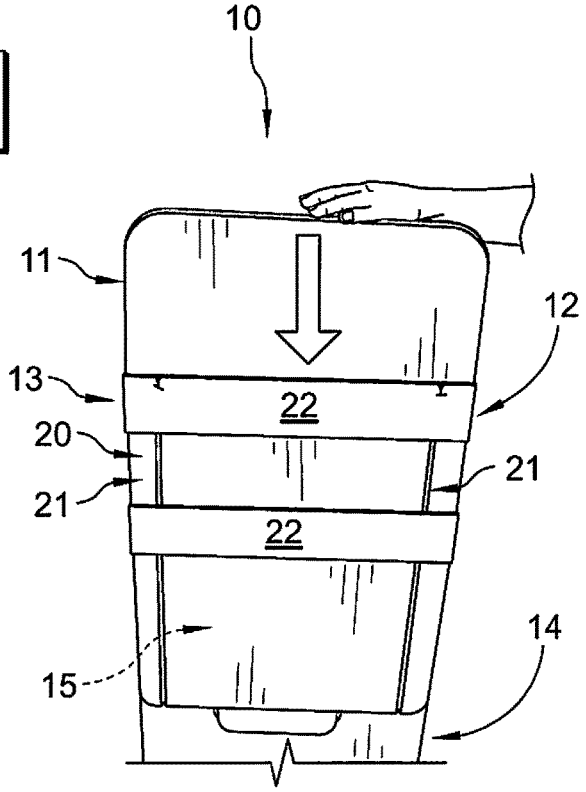
Figure 15:
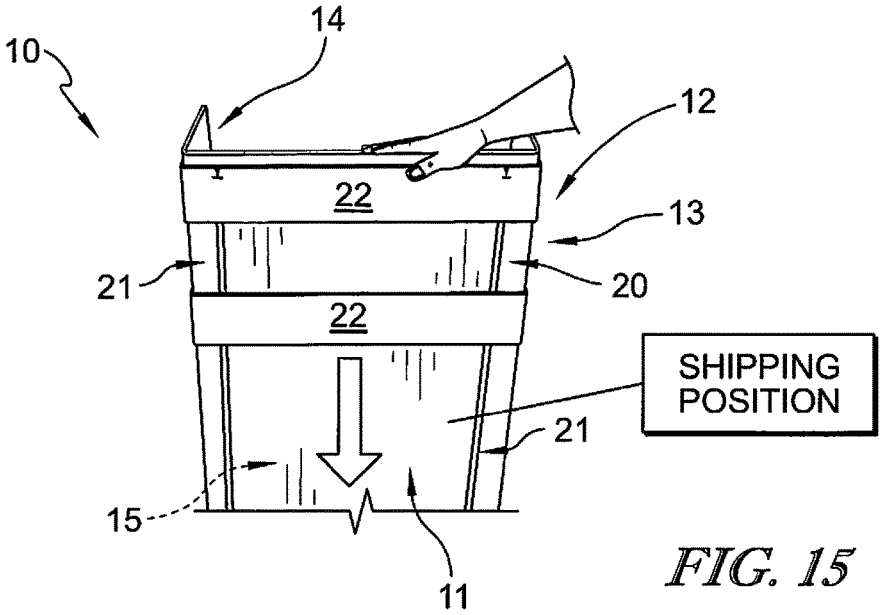

Header board 11 is inserted between back wall 15 of cabinet 14 and brackets 22 such that the front side of header board 11 is in confronting relation with back wall 15 as suggested in FIGS. 11 and 12. Elastic members 21 extend between upper bracket 22 and the lower end of header board 11 to support header board 11 on upper bracket 22 in the display position as suggested in FIG. 13. Elastic members 21 stretch to allow header board 11 to slide along back wall 15 to the shipping position at the selection of a user as suggested in FIGS. 14 and 15.

Figure 16:
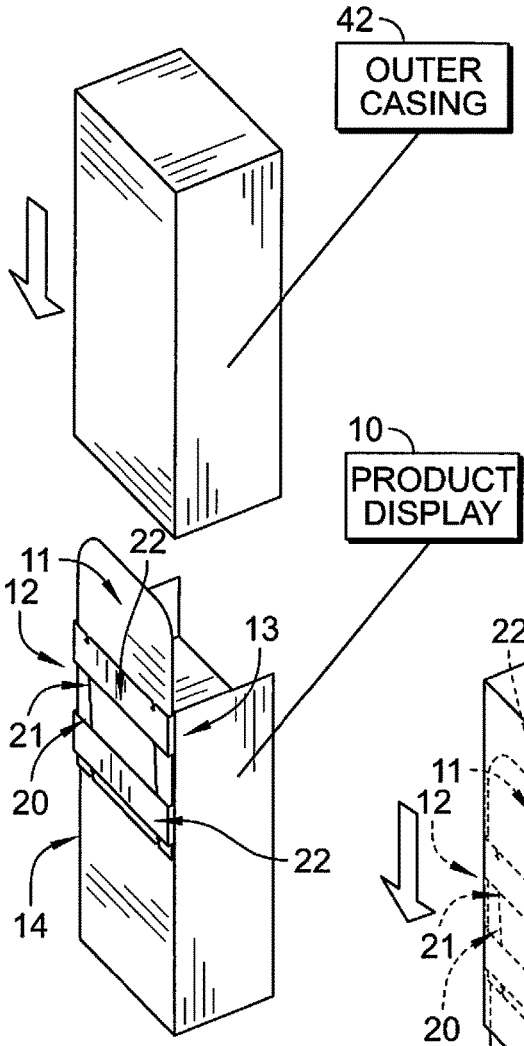
FIGS. 16-18 are a series of views showing a process in accordance with the present disclosure for forming a transport package by positioning an outer casing relative to the product display.
Figure 17:
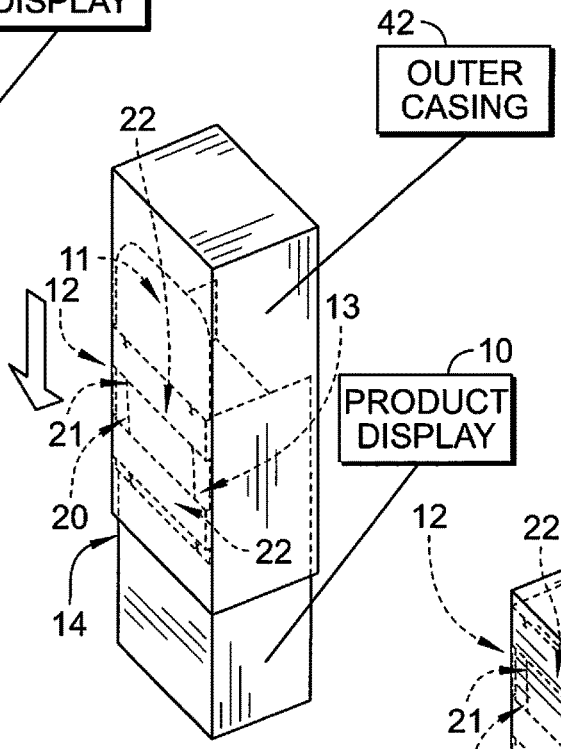
Figure 18:
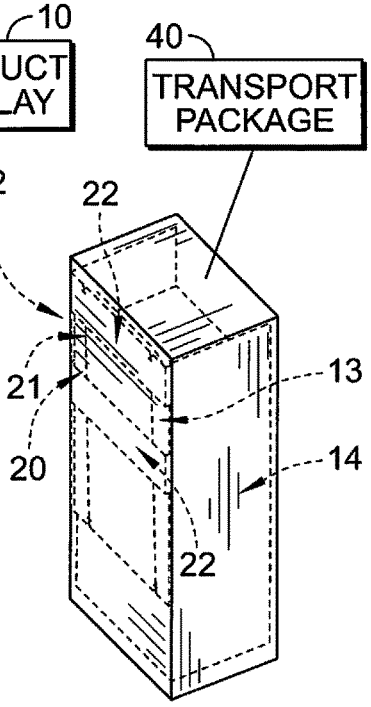

In some embodiments, display header 12 is attached to cabinet 14 before product is stored in cabinet 14 and shipped to a retail location. Display header 12 is moved to the shipping position and an outer casing 42 is positioned to surround product display 10 to form a transport package 40 and retain the product on cabinet 14 and hold display header 12 in the shipping position during transit of product display 10 to a retail location as suggested in FIGS. 16-18. A user of product display 10 removes outer casing 42 to expose the product stored in cabinet 14 and header mount 13 moves header board 11 to the display position for showing product indicia 16 to customers at the retail location.

Figure 19:
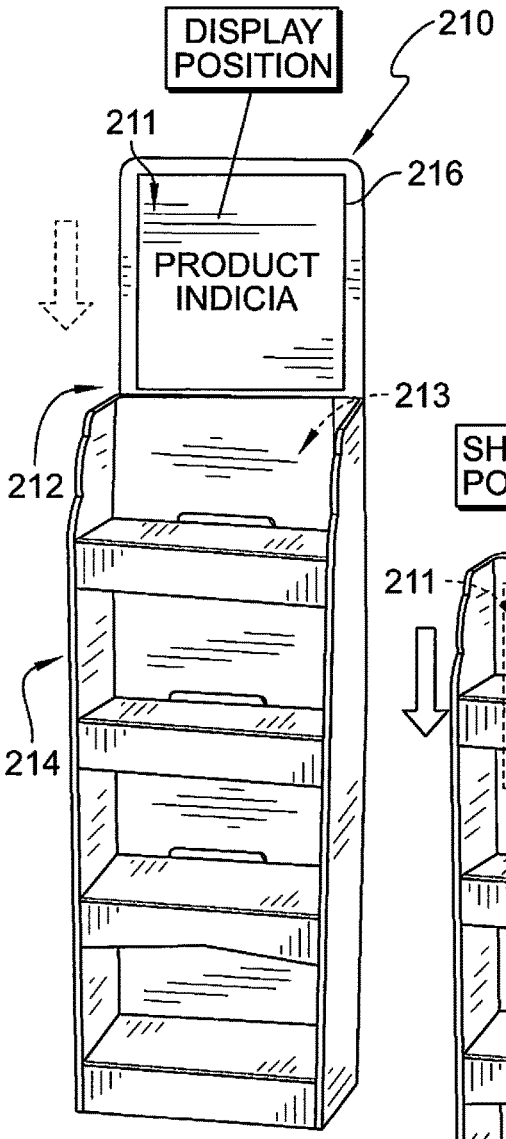
FIG. 19 is a front perspective view of another embodiment of a product display in accordance with the present disclosure showing that the product display includes a display header coupled to a cabinet for showing product indicia related to products stored in the cabinet to a customer at a retail location when the display header is in a display position.
Figure 20:
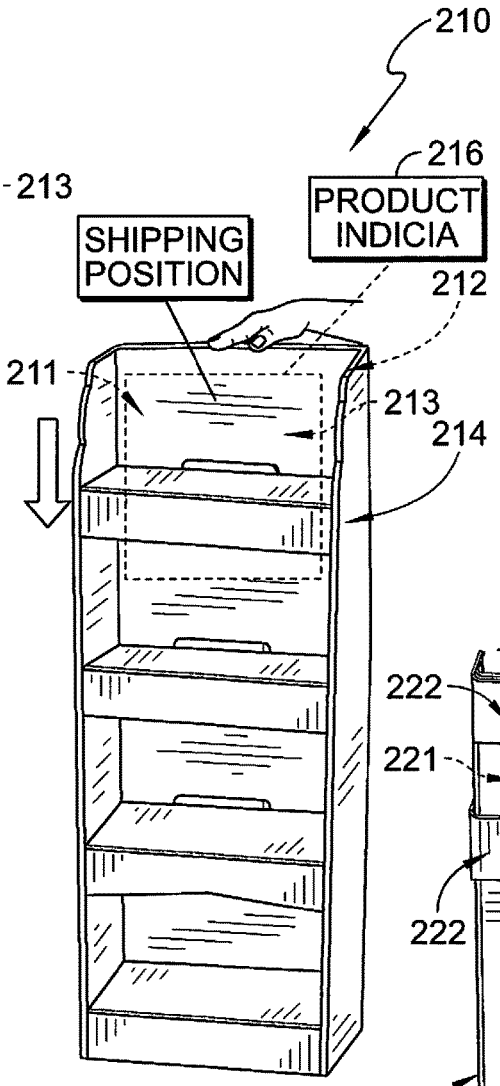
FIG. 20 is a view similar to FIG. 19 showing the display header in a shipping position and suggesting that at least a portion of the product indicia is obscured when the display header is in the shipping position.
Figures 27, 28, 29, 30:
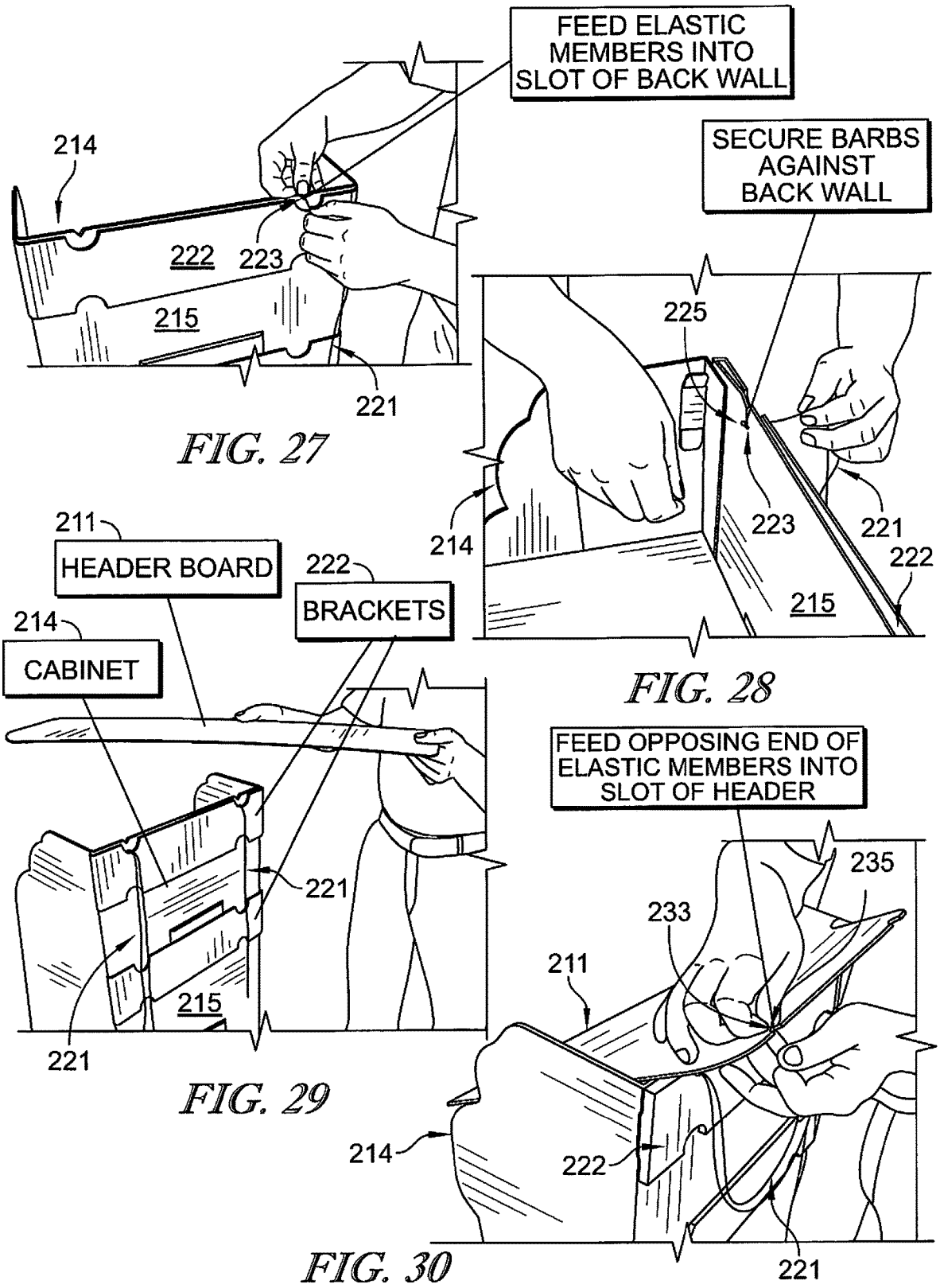
FIGS. 29-32 are a series of views showing a process in accordance with the present disclosure for attaching the header board to the header mount.

Another embodiment of a product display 210 in accordance with the present disclosure is shown in FIGS. 19 and 20. Product display 210 includes a display header 212 coupled to a cabinet 214. Cabinet 214 is configured to support product for display in a retail setting. Product indicia 216 related to products stored in cabinet 214 is positioned on a front side of display header 212 and visible when display header 212 is in a display position as shown in FIG. 27.

Display header 212 includes a header board 211 and a header mount 213 coupled to cabinet 214 to support header board 211 for movement relative to cabinet 214 between the display position, as shown in FIG. 19, and a shipping position, as shown in FIG. 20, at the selection of a user. At least a portion of product indicia 216 is obscured from view when header board 211 is in the shipping position and a height of product display 210 is reduced compared to when header board 211 is in the display position. In the illustrative embodiment, header mount 213 biases header board 211 toward the display position to support the header board 211 in the display position for showing product indicia 216 to customers at a retail location as suggested in FIG. 19.

Figure 21:
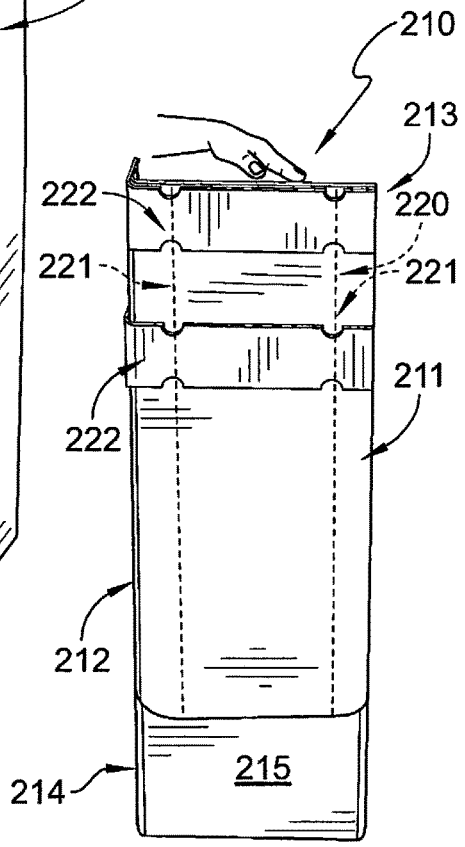
FIG. 21 is a rear perspective view of the product display of FIG. 20 showing that the display header includes a header board and a header mount configured to hold the header board on the cabinet for movement between the display position and the shipping position.

Header mount 213 includes one or more brackets 222 and a board mover 220 as shown in FIG. 21. Brackets 222 are coupled to a back wall 215 of cabinet 214 and are configured to guide header board 211 during movement between the display and shipping positions. In the illustrative embodiment, board mover 220 is coupled between cabinet 214 and header board 211 to support header board 211 in the display position. In some embodiments, board mover 220 is coupled between brackets 222 and header board 211 to support header board 211 in the display position. Board mover 220 includes elastic members 221.

Figure 22:
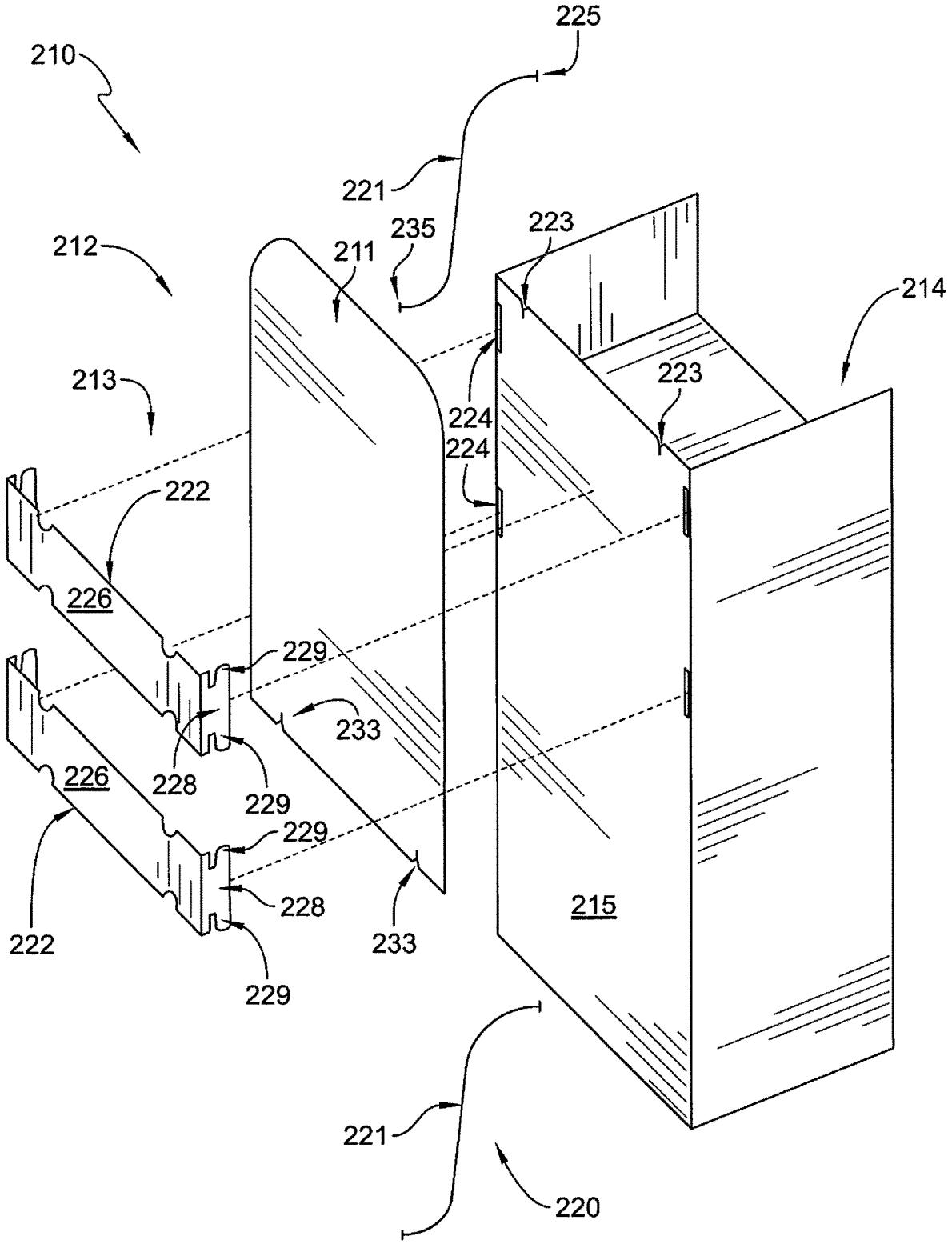
FIG. 22 is an exploded assembly view of the product display of FIG. 19 showing that the header mount includes brackets and elastic members and suggesting that the brackets engage with the cabinet to trap the header board between the brackets and the cabinet and that the elastic members engage with an upper portion of the cabinet and the header board to bias the header board toward the display position.
Figure 23:
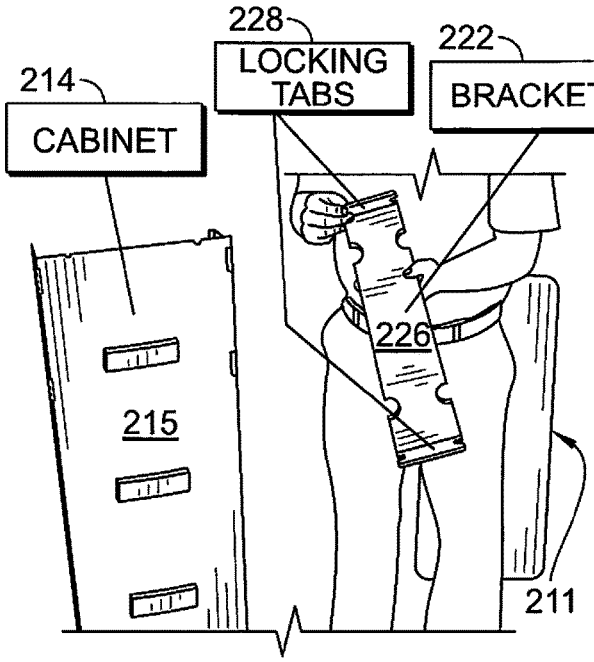
FIGS. 23-28 are a series of views showing a process in accordance with the present disclosure for attaching the header mount to the cabinet.
Figure 24:
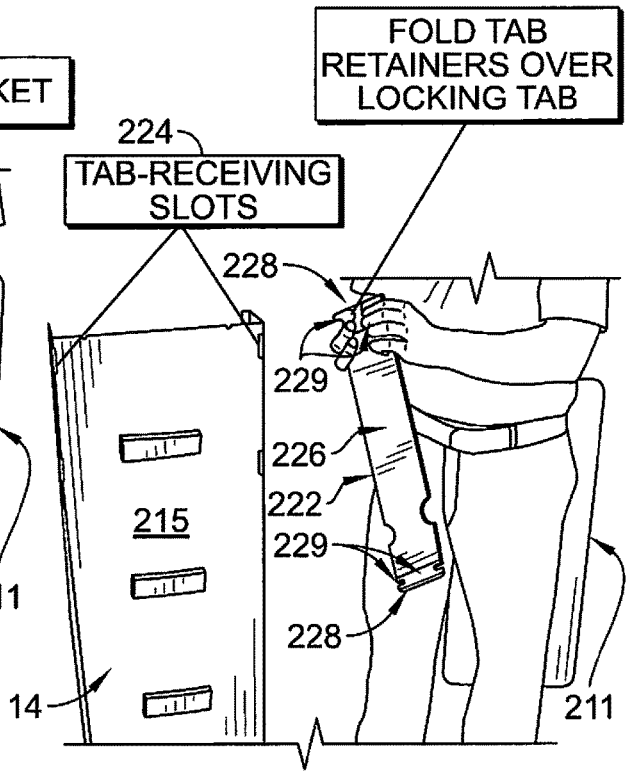
Figure 25:
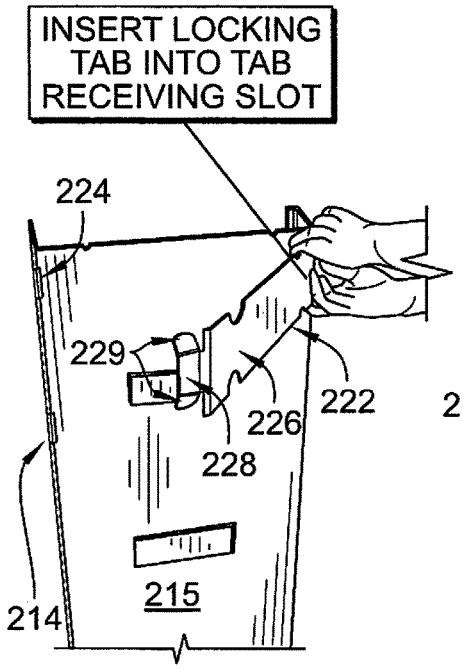
Figure 26:
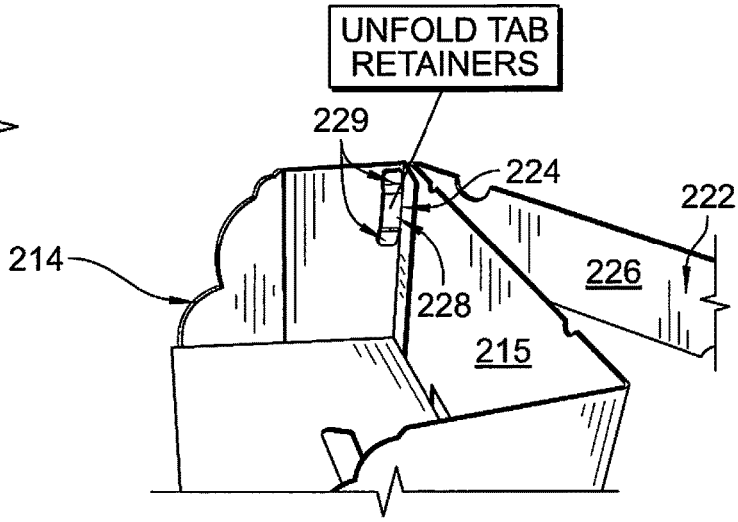

In the illustrative embodiment, two brackets 222 and two sets of elastic members 221 are used to form header mount 213 as suggested in FIG. 22. Elastic members 221 are coupled between an upper portion of cabinet 214 and a lower end of header board 211. Elastic members 221 are configured to stretch when header board 211 is moved to the shipping position and bias header board 211 toward the display position. In the illustrative embodiment, elastic members 221 are formed as elongated strands of stretchable material The number of brackets 222 and elastic members 221 can be increased or decreased to adjust for size, weight, display position height, etc. of display header 212 and cabinet 214.

Brackets 222 and header board 211 are formed separate from cabinet 214 as suggested in FIG. 22. Brackets 222 include an elongated guide wall 226 and locking tabs 228 extending form opposite sides of guide wall 226. In the illustrative embodiment, cabinet 214 is formed to include tab-receiving slots 224 configured to receive lock tabs 228 of brackets 222. One or more retainer tabs 229 extend laterally from lock tabs 228. Brackets 222 attach to cabinet 214 to trap header board 211 between brackets 222 and cabinet 214 as suggested in FIG. 22.

One illustrative process for attaching display header 212 to cabinet 214 is shown in FIGS. 23-32. Retainer tabs 229 are folded over lock tab 228 to allow lock tab 228 and retainer tabs 229 to be inserted through slot 224 of cabinet 214 as suggested in FIGS. 23-26. Retainer tabs 229 are unfolded to engage with back wall 215 of cabinet 214 to block removal of lock tab 228 from slot 224 as suggested in FIG. 26. Lock tab 228 on an opposing end of bracket 222 is inserted into slot 224 on an opposing side of cabinet 214 in a similar way. Lock tabs 228 and retainer tabs 229 are configured to hold brackets 222 on cabinet 214. Lock tabs 228 are also configured to space guide wall 226 from back wall 215 to define a slot for receiving header board 211.

Elastic members 221 are inserted into slots 223 formed in an upper portion of cabinet 214 as suggested in FIGS. 27 and 28. Barbs 225 coupled to ends of elastic members 221 are secured against back wall 215 when elastic members 221 are inserted into slot 223 to support elastic members on back wall 215 as suggested in FIG. 28. Elastic members 221 are secured at an opposing side of cabinet 214 in a similar way.

Header board 211 is positioned adjacent to cabinet 214 for attachment of elastic members 221 as suggested in FIGS. 29 and 30. Opposing ends of the elastic members 221 from those attached to back wall 215 are inserted into slots 233 of header board 211. Barbs 235 coupled to the ends of elastic members 221 are secured against header board 211 to block withdrawal of elastic members 221 from slot 233 during movement of header board 211 and to support header board 211 on back wall 215. Elastic members 221 are secured at an opposing side of header board 211 in a similar way.

Figure 31:
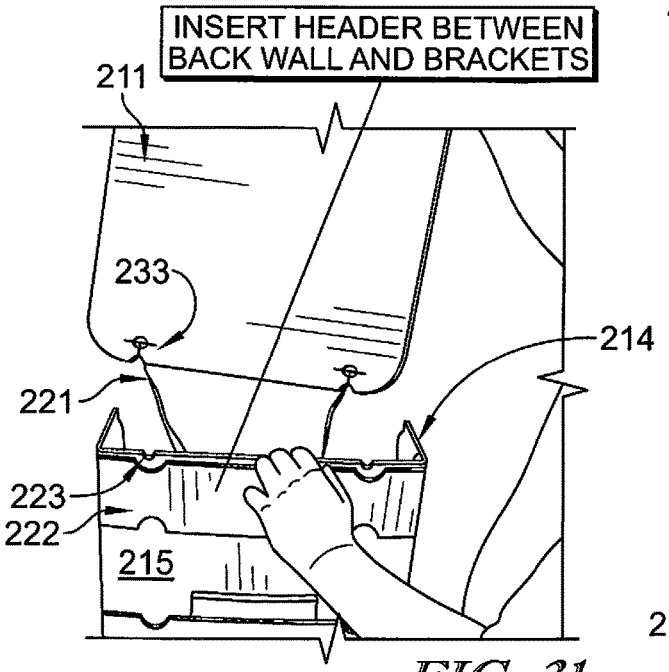
Figure 32:
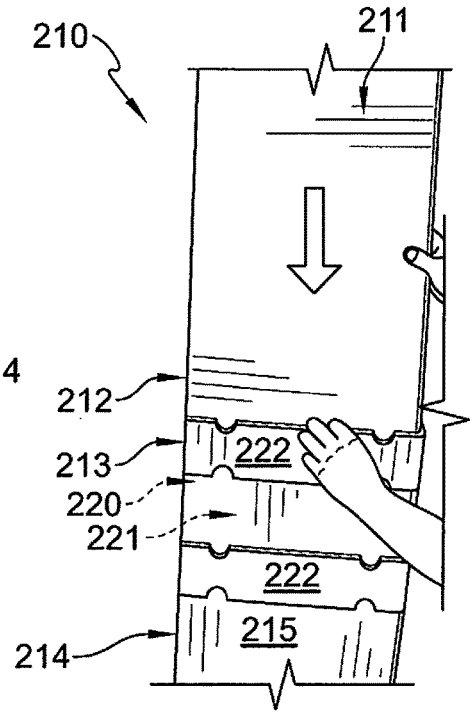
Figure 33:
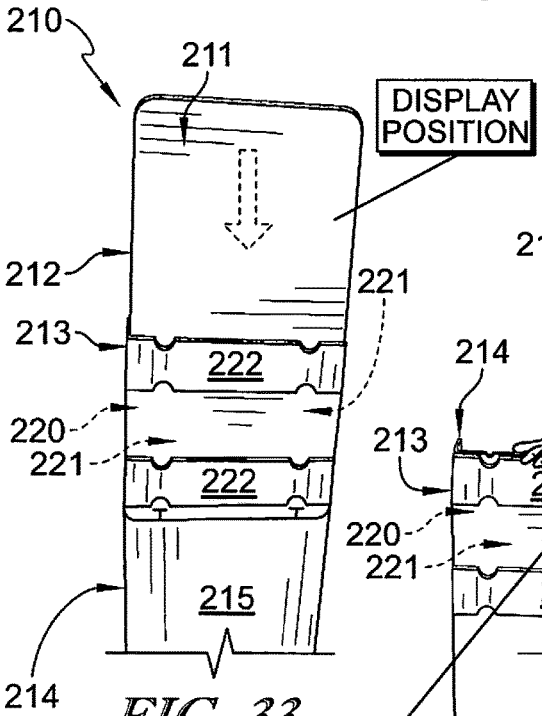
FIGS. 33-35 are a series of views showing the header board in various positions relative to the header mount.
Figure 34:
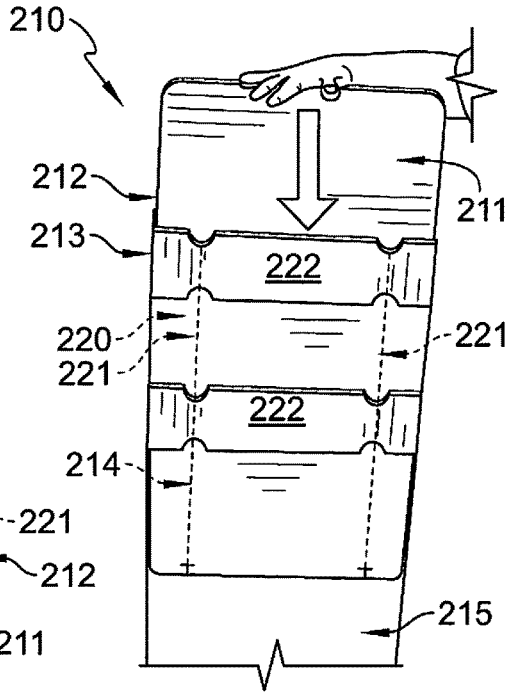
Figure 35:
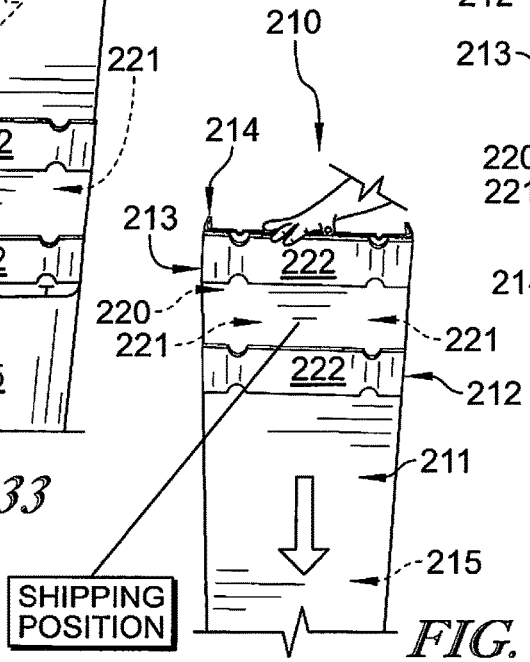

Header board 211 is inserted between back wall 215 of cabinet 214 and brackets 222 such that the front side of header board 211 is in confronting relation with back wall 215 as suggested in FIGS. 31 and 32. Elastic members 221 extend between the upper portion of cabinet 214 and the lower end of header board 211 to support header board 211 on cabinet 214 in the display position as suggested in FIG. 33. Elastic members 221 stretch to allow header board 211 to slide along back wall 215 to the shipping position at the selection of a user as suggested in FIGS. 34 and 35.

In some embodiments, display header 212 is attached to cabinet 214 before product is stored in cabinet 214 and shipped to a retail location. Display header 212 is moved to the shipping position and an outer casing is positioned to surround product display 210 to retain the product on cabinet 214 and hold display header 212 in the shipping position during transit of product display 210 to a retail location. A user of product display 210 removes the outer casing to expose the product stored in cabinet 214 and header mount 213 moves header board 211 to the display position for showing product indicia 216 to customers at the retail location.

It is within the scope of the present disclosure to make cabinets, header boards, and brackets in accordance with the present disclosure from a variety of materials including corrugated paperboard, folding carton, solid fiber, plastic sheeting, plastic corrugated, combinations thereof, or any other suitable material. In illustrative embodiments, cabinets 14, 214, header boards 11, 211, and brackets 22, 222 may be formed from the same or different materials.

In illustrative embodiments, the display headers 12, 212 automatically pop-up when used. The display headers 12, 212 are adaptable for use with a variety of cabinets in a retail environment.

In illustrative embodiments, brackets 22, 222 are used to hold a graphic header 11, 211 in place as the header 11, 211 is in a shipping (or down) position during shipment or in a display (or up) position when deployed. The brackets 22, 222 are used as a guide to help move the header 11, 211 up and down and protect the header 11, 211 in the down position during shipment. The brackets 22, 222 can be made out of corrugated, plastic, or other materials such as solid fiber. The brackets 22, 222 attach to a display vehicle (such as a cabinet) via lock tabs received in the back of the display or attached with a double-sided adhesive strip.

In illustrative embodiments, elastic cords 21, 221 with barbs 25, 35, 225. 235 attached to the ends are used to pull up the graphic header 11, 211 when a cover, shroud, or outer casing is removed from the product display 10, 210 in a retail location. More or less cords are used depending on the size and weight of the header 11, 211, and 3D effects which may cause friction between the header 11, 211 and back wall 15, 215. A length of the elastic cords 21, 221 can be adjusted based on the height of the header 11, 211 used in the product display 10, 210.

In illustrative embodiments, the header 11, 211 is a planar board of corrugated or other material. Graphics or other indicia 16, 216 are applied to the header 11, 211 by direct print, litho label (full or spot mount), litho lamination, screen printing, or digital printing for example. The header 11, 211 may also include 3D elements which may move relative to the header board as the header moves upward or downward.

In illustrative embodiments, display header 12, 212 includes elastic bands 21, 221, brackets 22, 222, and a graphic header board 11, 211 which in combination attach to a retail display vehicle or cabinet 14, 214. Once the display header is attached to a display vehicle, the graphic header board is moved into the down position for shipment. A shrink film or corrugated shroud are placed around the cabinet and display header to protect it for shipment. Once the display vehicle arrives to its intended destination (e.g., a retail location), a user removes the protective cover and the header board will automatically be lifted upward via the elastic bands into the up position therefore showing the graphics on the front and/or back.

In illustrative embodiments, no labor is involved by a user in the retail setting. This solves a problem in that current graphic headers ship loose or separate from the display vehicle. Many times those loose headers are placed on the top or may be attached via plastic rivets or clips. In either case, a user must find the header (if loose), read the set up instruction sheet, and attach the header to the display vehicle. The display headers 12, 212 of the present disclosure automatically moves the graphic element (e.g., header board 11, 211) up into position meeting retail compliance requirements and saving labor. The display headers 12, 212 also attach to pre-existing display vehicles.

In illustrative embodiments, product support structures or display vehicles can include cabinets, stacked trays, three-sided structures, and other structures that support or otherwise store product for display and transportation.

The invention claimed is:

1. A product display comprising a cabinet adapted to support product for display in a retail location and a display header coupled to the cabinet, the display header including a header board and a header mount coupled to the cabinet in a fixed position relative to the cabinet, wherein the header mount is configured to support the header board in a display position where product indicia positioned on the header board is visible and to allow the header board to slide along the cabinet relative to the cabinet and the header mount from the display position to a shipping position at the selection of a user where at least a portion of the product indicia is obscured by the cabinet and to reduce a height of the product display;

wherein the header mount includes a bracket coupled to the cabinet to trap the header board between the bracket and the cabinet and an elastic member configured to bias the header board toward the display position;

wherein the elastic member engages with an upper portion of the cabinet and a lower portion of the header board to support the header board in the display position.

2. The product display of claim 1, wherein the bracket includes a guide wall and a lock tab coupled to the guide wall, and wherein the cabinet is formed to include a tab-receiving slot configured to receive the lock tab of the bracket to hold the bracket on the cabinet.

3. The product display of claim 2, wherein the lock tab includes retainer tabs extending in opposite outward directions and are configured to engage with the cabinet to hold the bracket on the cabinet.

4. The product display of claim 1, wherein the bracket is formed to include a foldable end configured to interconnect the bracket to the cabinet with adhesive.

5. The product display of claim 4, wherein the elastic member is engaged with the bracket and a lower portion of the header board to support the header board in the display position.

6. The product display of claim 1, further comprising a removable cover at least partially enclosing the cabinet and the display header and configured to maintain the header board in the shipping position.

7. The product display of claim 6, wherein the header board is configured to automatically move from the shipping position to the display position upon removal of the removable cover.

8. The product display of claim 7, wherein the removable cover comprises a shrink film.

9. The product display of claim 7, wherein the removable cover comprises a corrugated shroud.

* * * * *